US009668541B2

(12) United States Patent
Lee et al.

(10) Patent No.: US 9,668,541 B2
(45) Date of Patent: Jun. 6, 2017

(54) ARTICLE OF FOOTWEAR, SOLE AND PUMP ARRANGEMENT FOR USE IN SAME, AND METHOD OF MAKING SAME

(75) Inventors: Neville Ka Shek Lee, Hong Kong (CN); Chi Kit Chan, Hong Kong (CN); Samuel Sing-Kwong Hui, Hong Kong (CN)

(73) Assignee: CEDAR TECHNOLOGIES INTERNATIONAL LTD., Hong Kong (CN)

( * ) Notice: Subject to any disclaimer, the term of this patent is extended or adjusted under 35 U.S.C. 154(b) by 295 days.

(21) Appl. No.: 14/382,684

(22) PCT Filed: May 23, 2012

(86) PCT No.: PCT/US2012/039099

§ 371 (c)(1),
(2), (4) Date: Sep. 3, 2014

(87) PCT Pub. No.: WO2013/133858

PCT Pub. Date: Sep. 12, 2013

(65) Prior Publication Data

US 2015/0027005 A1 Jan. 29, 2015

Related U.S. Application Data

(60) Provisional application No. 61/608,630, filed on Mar. 8, 2012.

(51) Int. Cl.

| | |
|---|---|
| ***A43B 13/18*** | (2006.01) |
| ***A43B 13/20*** | (2006.01) |
| ***A43B 7/08*** | (2006.01) |

(52) U.S. Cl.

CPC ..... *A43B 13/203* (2013.01); *A43B 7/081* (2013.01); *A43B 13/181* (2013.01); *A43B 13/183* (2013.01); *A43B 13/20* (2013.01)

(58) Field of Classification Search

CPC ..... A43B 13/203; A43B 13/20; A43B 7/081; A43B 13/141; A43B 13/181; A43B 13/18;

(Continued)

(56) References Cited

U.S. PATENT DOCUMENTS 1,364,226 A * 1/1921 Wherry ..... A43B 7/06 36/147

1,504,908 A 8/1924 Sato (Continued)

OTHER PUBLICATIONS

International Search Report for PCT/US2012/039099 dated Aug. 16, 2012.

*Primary Examiner* — Khoa Huynh
*Assistant Examiner* — Katharine Gracz
(74) *Attorney, Agent, or Firm* — Heslin Rothenberg Farley & Mesiti P.C.; Victor A. Cardona, Esq.

(57) ABSTRACT

An article of footwear has a shoe upper, a sole connected to the shoe upper and the sole is provided with peripheral walls which together define a cavity therein. A layer of material extends across and is connected to the walls or adjacent to the walls at a perimeter of the layer of material, the layer of material dividing the cavity into at least a first chamber and a second chamber. The layer of material and the walls on one side of the perimeter of the layer of material define the first chamber, and the layer of material and the walls on the other side of the perimeter of the layer of material define the second chamber. The sole is configured such that movement of the layer of material within the cavity causes simultaneous changing of interior volume between the chambers and thus pumping of air into or out of the chambers for air circulation of the article of footwear.

15 Claims, 10 Drawing Sheets

(58) Field of Classification Search
CPC ..... A43B 13/183; A43B 13/185; A43B 7/32; A63B 25/10
USPC ..... 36/28, 27, 102, 3 B
See application file for complete search history.

(56) References Cited

U.S. PATENT DOCUMENTS 3,039,207 A * 6/1962 Lincors ..... A43B 13/18 36/58.5
3,716,930 A 2/1973 Brahm
3,973,336 A * 8/1976 Ah ..... A43B 7/081 36/3 B
4,069,599 A * 1/1978 Alegria ..... A43B 3/20 36/106
4,071,963 A 2/1978 Fukuoka
4,438,573 A 3/1984 McBarron
4,561,195 A 12/1985 Onoda et al.
4,864,737 A 9/1989 Marrello
5,282,325 A * 2/1994 Beyl ..... A43B 13/182 36/27
5,517,769 A * 5/1996 Zhao ..... A43B 13/18 36/27
5,706,598 A * 1/1998 Johnston ..... F41C 9/08 42/51
6,044,577 A * 4/2000 Clark ..... A43B 7/082 36/29
6,625,902 B2 9/2003 Yamamoto
7,219,447 B2 * 5/2007 LeVert ..... A43B 7/1425 36/27
7,905,033 B1 * 3/2011 Perenich ..... A43B 13/141 36/102
2004/0068891 A1 * 4/2004 Wang ..... A43B 1/0018 36/27
2005/0268488 A1 * 12/2005 Hann ..... A43B 13/20 36/27
2006/0032083 A1 2/2006 Lim
2008/0263899 A1 * 10/2008 Lee ..... A43B 1/0045 36/102

* cited by examiner

ARTICLE OF FOOTWEAR, SOLE AND PUMP ARRANGEMENT FOR USE IN SAME, AND METHOD OF MAKING SAME

CROSS REFERENCE TO RELATED APPLICATIONS

This application is a National Stage of PCT International Application No. PCT/US2012/039099, filed on May 23, 2012, and published in English on Sep. 12, 2013 as WO 2013/133858 A1, which claims priority from U.S. patent application Ser. No. 61/608,630 filed on Mar. 8, 2012, the entire disclosures of which are incorporated herein by reference.

FIELD OF THE INVENTION

The present invention is concerned with an article of footwear and in particular an article of aerated footwear, a sole and pump arrangement for use in such article of footwear, and a method of making thereof.

BACKGROUND OF THE INVENTION

There are a variety of footwear products in the market. Some footwear products are tailored to provide a better cushion for absorbing shocks generated during walking movement of a user. In recent years, there have been proposed different types of footwear articles seeking to promote ventilation in the shoe upper.

One way to effect ventilation is to provide a bladder-type pump device in a cavity located in the sole of a shoe such that on compression of the pump device air ventilation can be generated. However, among other problems, operating such pump device efficiently has been shown to be rather difficult. Further, the size and thickness of the sole in a shoe is often limited such that the size of the pump device situated in the sole is also limited, thus hindering the magnitude of ventilation that can be generated to the shoe.

The present invention seeks to provide an improved article of footwear that can effect ventilation within the shoe upper thereof more efficiently, or at least to provide an alternative to the public.

SUMMARY OF THE INVENTION

According to a first aspect of the present invention, there is provided an article of footwear, comprising a shoe upper, a sole connected to the shoe upper and the sole is provided with peripheral walls which together define a cavity therein, a layer of material extending across and connected to the walls or adjacent to the walls at a perimeter of the layer of material, the layer of material dividing the cavity into at least a first chamber and a second chamber, wherein the layer of material and the walls on one side of the perimeter of the layer of material define the first chamber, and the layer of material and the walls on the other side of the perimeter of the layer of material define the second chamber, and the sole is configured such that movement of the layer of material within the cavity causes simultaneous changing of interior volume between the chambers and thus pumping of air into or out of the chambers for air circulation of the article of footwear. The presence of the layer of material extending across the walls can maximize the use of space inside the sole so as to accordingly increase the magnitude of air circulation generated during reciprocating movement of the layer of material.

Preferably, the layer of material may be relatively thin and flexible. The layer of material may be elastic or define vertical grooves or folds for facilitating resilient stretching or movement thereof.

In an embodiment, the article of footwear may comprise an elongate actuation member provided with a front portion and a rear portion pivotably movable relative to the front portion within the cavity. The actuation member may be adapted such that, in use, the rear portion of the actuation member from a predetermined configuration in relation to the front portion of the actuation member may be stiffer to bend down then to bend up or vice versa. The rear portion generally may define a first plane and the front portion generally may define a second plane, and wherein the predetermined configuration may be defined by an angle between the first plane and the second plane or relative position of the front and rear portions.

The article of footwear may comprise a hinge member connecting, when the article of footwear in normal upright orientation, an upper surface of the front and rear portions of the actuation member and allowing upwardly pivotable movement of the rear portion. The front and rear portions may be positioned such that adjacently facing ends of the portions restrict downwardly pivotable movement of the rear portion. The actuation member may be fixedly connected to the layer of material such that upwardly bending of a rear portion of the sole relative to a front portion of the sole downwardly stretches the layer of material, and expanding the volume within the first cavity and/or reducing the volume within the second cavity.

In one embodiment, the article of footwear may comprise means for allowing expansion of the volume of the cavity within the sole. The expansion allowance means includes a thinner or more stretchable region disposed on or provided at a bottom wall of the sole. The expansion allowance means may comprises a plurality of grooves or folds at the thinner or more stretchable region. Alternatively, the expansion allowance means may comprise micro-incisions at the thinner or more stretchable region.

In a particular embodiment, the walls may include a bottom wall provided with a stretchable portion which in response to bending of the sole facilitates the stretchable portion to bulge out, allowing the actuation member connected to the layer of material or the layer of material itself to move a greater distance so as to provide a greater pumping action.

According to a second aspect of the present invention, there is provided an article of footwear comprising a shoe upper, and a sole having peripheral walls defining a cavity within the sole, wherein the article of footwear further comprises means provided at a bottom wall of the sole facilitating outwardly expansion of the bottom wall in response to bending of the sole in use, thus increasing the volume of the cavity of the sole. An increase in volume of the cavity can enhance the magnitude of air circulation generated in use.

According to a third aspect of the present invention, there is provided a sole for use in an article of aerated footwear, comprising a) a sole body connectable to a shoe upper, the sole body provided with peripheral walls which together define a cavity therein, b) a membrane connected to the walls or adjacent to the walls at a perimeter of the membrane and dividing the cavity into at least a first chamber and a second chamber, wherein the membrane and the walls on one side of the perimeter of the membrane define the first chamber, and the membrane and the walls on the other side of the perimeter of the membrane define the second chamber, and c) the sole is configured such that movement of the membrane within the cavity causes changing of interior volume within the chambers and thus pumping of air into or out of the chambers for air circulation.

According to a fourth aspect of the present invention, there is provided a sole for use in an article of aerated footwear, comprising a sole body provided with peripheral walls which together define a cavity within the sole body, wherein the sole body further comprises means provided at a bottom wall allowing outwardly expansion of the bottom wall in use, thus increasing the volume of the cavity of the sole and to facilitate generation of greater aeration for the article of footwear.

According to a fifth aspect of the present invention, there is provided a pump assembly for an article of aerated footwear comprising a pump membrane having a) a membrane member fixedly connected to peripheral walls or adjacent to the peripheral walls of a sole body, and situated in cavity of the sole body of, the article of footwear; the membrane member extending across the sole body in the cavity, and b) an actuation member connected to the membrane member for effecting movement of the membrane member in response to bending or unbending of the sole, such as to provide air circulation to the article of footwear.

Preferably, the sole body may include a bottom wall configured to be outwardly expandable in response to bending movement of the sole body.

According to a sixth aspect of the present invention, there is provided a method of manufacturing a sole body for an article of footwear, comprising steps of a) moulding a sole member with surrounding walls such that the surrounding walls defining a cavity therebetween, b) providing a membrane member defining a perimeter and sized and shaped to connect to the surrounding walls at the perimeter, c) fixedly connecting the membrane member to the surrounding walls, and d) enclosing the cavity by connecting a covering member to the surrounding walls.

Preferably, the method may comprise a step of connecting an actuation member to the membrane member for operating the membrane member in use The method may comprise a step of connecting the membrane member to the surrounding walls by gluing the membrane member to the surrounding walls.

BRIEF DESCRIPTION OF THE DRAWINGS

Some embodiments of the present invention will now be explained, with reference to the accompanied drawings, in which.

DETAILED DESCRIPTION OF PREFERRED EMBODIMENTS OF THE PRESENT INVENTION

There have been proposals of providing aerated footwear articles by making use of conventional bladder-typed pumps. One example of such proposals is disclosed in WO2007/120583, content of which is incorporated herein in its entirety.

While these pumps are able to promote air ventilation, their effectiveness is limited by a number of factors. For example, such pumps are generally harder and yet require the presence of pleats or a bellow structure thus allowing them to expand or compress with minimal force. Yet even with the pleats or a bellow such pumps are still difficult to compress sufficiently enough unless they are made to be very thin or fragile but then they would be too thin or fragile. Further, with limited space available in the sole the pleats or the bellows structure would take up precious space or there isn't sufficient space provided to allow effective performance of the pumps altogether whereas the disclosure herein introduces a novel pump design that can accommodate a wider cross-section. Another factor is that lateral movement of an actuator or springboard attached to and for actuation of the pumps is often caused when the sole is bent, leading to stress or damages to the pumps. Yet further, in order to provide sufficient force for operating the pumps the actuator would have to be constructed to be sufficiently firm when pressed from one direction, while at the same time sufficiently resilient but flexible when pressed from the other side. The firmness of the actuator is required such that it would be able to adequate compress the pump, and the resilience would also be required so that the springboard would bend without damaging the bottom of the sole, when the angle or force exceeded what was necessary to expand the pump.

Figure 1A:
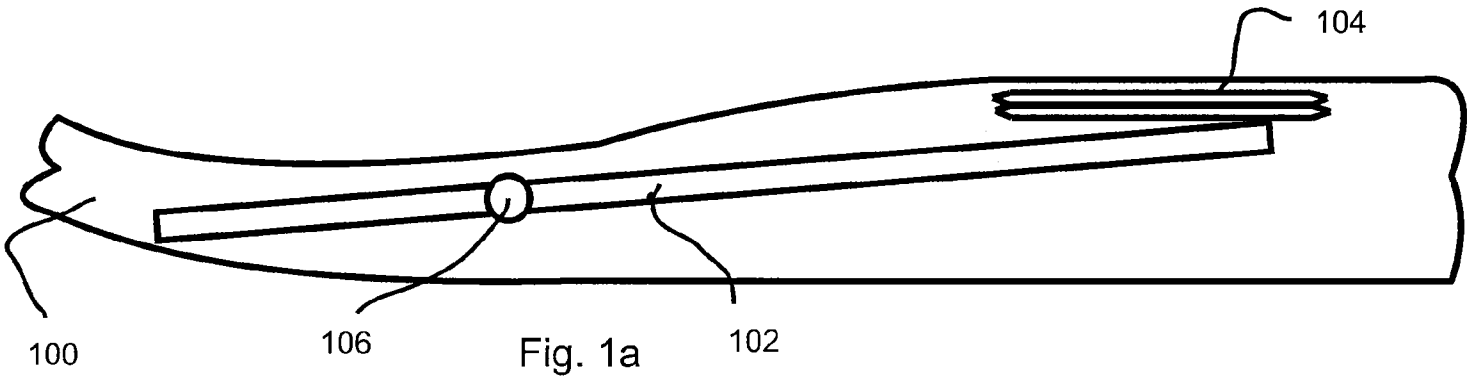
FIG. 1*a* is a schematic cross sectional view showing a sole of an article of aerated footwear disposed in one configuration.
Figure 1B:
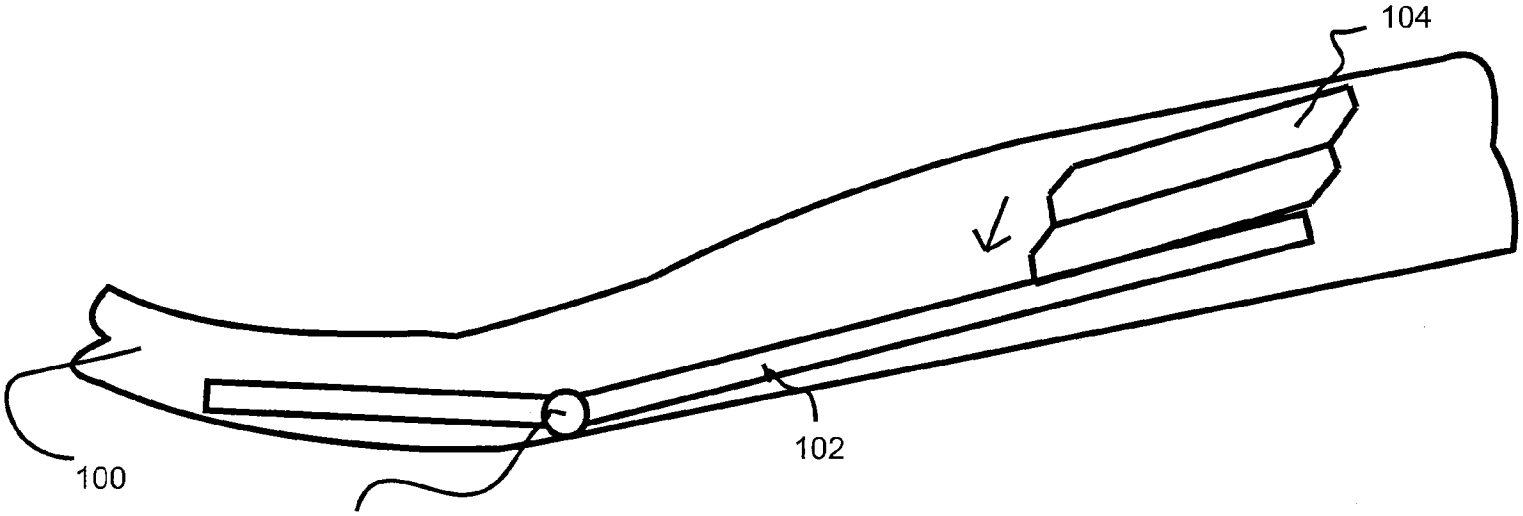
FIG. 1*b* is a schematic cross sectional view of the sole of FIG. 1*a* but disposed in a different configuration.

FIGS. 1*a-b* depict an exemplary sole 100 of a prior art aerated footwear in which a bladder-type pump 104 is provided and is actuable by a springboard 102. The springboard 102 is provided with a front portion and a rear portion connected to the front portion by a hinge 106 in the form of a resilient coiled spring. The spring has a rotational axis or bending point at which the springboard 102 pivots. It is envisaged that in use when the footwear article is worn by a user during walking, the sole is reciprocatingly bent and unbent. FIG. 1*a* shows the pump 104 in a compressed state. Nevertheless, due to the constructional nature of the pump 104 the pump 104 even in a compressed state still occupies a considerable amount of space in the sole 100. Increasing the amount of space within the sole 100 would allow the pump 104 to expand or compress to a greater extent although increasing the space in most footwear articles would not be possible realistically. It can also be envisaged that the movement of the springboard 102 often would cause the pump 104 to be deformed in a lateral position which is not desirable.

Referring to FIGS. 2*a-e* and 3*a-c*, there is illustrated a first embodiment of a shoe sole 100 of an article of aerated footwear according to the present invention. It is to be noted that for sake of ease of comparison like parts when compared to those in FIGS. 1*a-b* are designated with the like reference numerals. One characteristic of the sole 100 in the first embodiment is the provision of a membrane-type pump member in a cavity defined by surrounding walls of the sole 100. As shown in for example FIGS. 2*a* and 3*a*, the pump member is provided with a membrane 104*a* sealed against edges of the cavity surrounding the sole 100. It is the membrane 104*a* together with the surrounding walls that form the pump member. In this embodiment, the membrane 104*a* is provided with grooves or folded construction for easy mobility or stretching of the membrane 104*a* during operation. The foldability or the strectchbility of the membrane 104*a* are clearly indicated by the wavy lines 308 shown in FIGS. 3*a-c*.

The pump member is also provided with a springboard 102 attached thereto. The springboard 102 has a front portion and a rear portion connected together at a hinge 106*a*. In this embodiment, the hinge 106*a* takes the form of a spring that is generally flat and situated on top of the springboard 102 across adjacent ends of the front and rear portions of the springboard 102. It can be understood that the positioning of the spring 106*a* on the topside of the springboard 102 allows the rear portion of the springboard 102, with respect to the front portion of the springboard 102, to be upwardly bendable relative to the front portion, as shown in FIGS. 2*b-d* in direction X. On the other hand, the rear portion of the springboard 102 cannot be bent or at least is much stiffer to bend downwardly relative to the front portion in direction Z, as shown in FIG. 2*e*. This is because the adjacent ends of the front and rear portions at the hinge 106*a* restrict such relative downward movement. Due to this particular configuration, the springboard 102 possesses the unique property of being sufficiently rigid or stiff when pressed from one side (when the rear portion sustains a downward force) and is considerably more bendable or pivotable from the other side (when the rear portion sustains an upward force). It is to be noted that the springboard 102 is merely one possible embodiment of providing an elongate actuating member in which it is much stiffer to bend in one direction then the other. As such, this embodiment of the springboard 102 is merely an example and in no way limiting the scope of an elongate actuation member having different degree of stiffness when being bent from different directions. For instance, the same concept can be applied in other embodiments in which the springboard is adapted to be easier to bend down than to bend up.

In the embodiment in for example FIG. 2*e*, it is shown that the front portion of the actuation member generally defines a first plane and the rear portion of the actuation member generally defines a second plane, and that at a default configuration the first and second planes are coplanar with each other. The relationship of the first and second planes may also be described in that the angle between the two planes is 180°. It is however to be noted that this co-planar configuration or 180° relationship is not necessarily so. It is to be understood that depending on the particular design of the shoe the front and rear portions may be adapted and predetermined such that at default the first and second planes are not coplanar and the angle between the two planes may be less than 180°, e.g. at about 135°. In such embodiment, from the predetermined configuration of about 135°, the rear portion is stiffer to bend down than to bend up. Alternatively, in other embodiments the angle between the two planes may be larger than 180° for particular design needs. Accordingly, the default configuration of the actuation member can be designed in various ways. For example, the adjacent ends of the front portion and the rear portion can be sized and shaped to be curved and/or angled such that at default the front and rear portions may adopt a certain predetermined relative position or their planes may lay in a non-coplanar manner. This flexibility allows the application of the invention in a variety of shoe design, for example in shoes which have a curved sole.

Figure 2A:
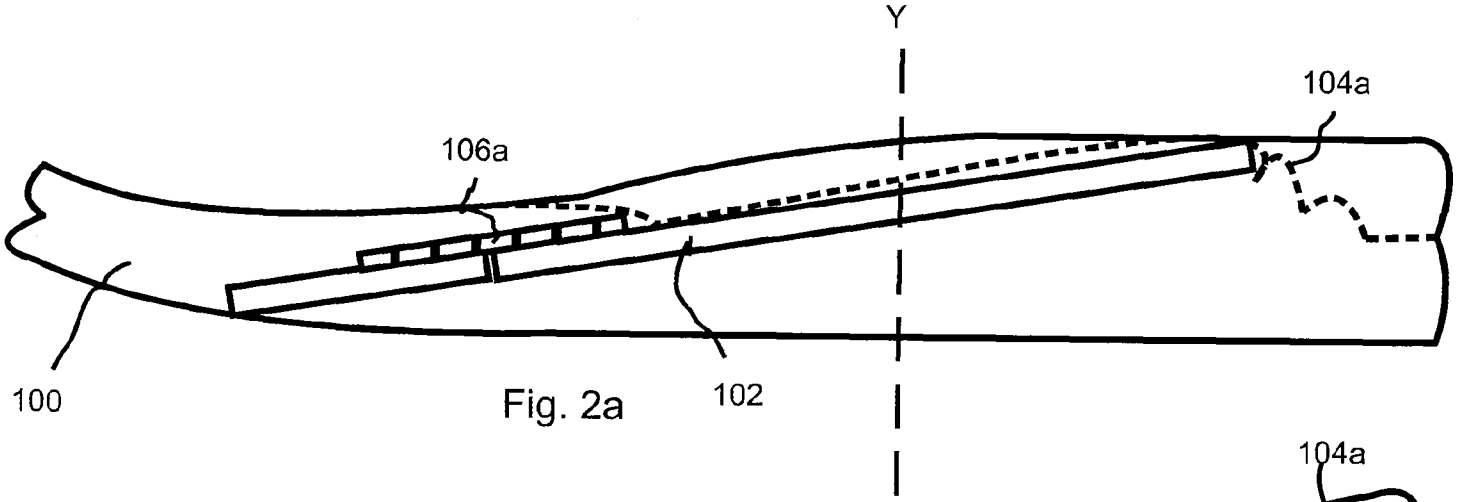
FIG. 2*a* is a schematic cross sectional view showing an embodiment of a sole for an article of footwear according to the present invention.
Figure 2B:
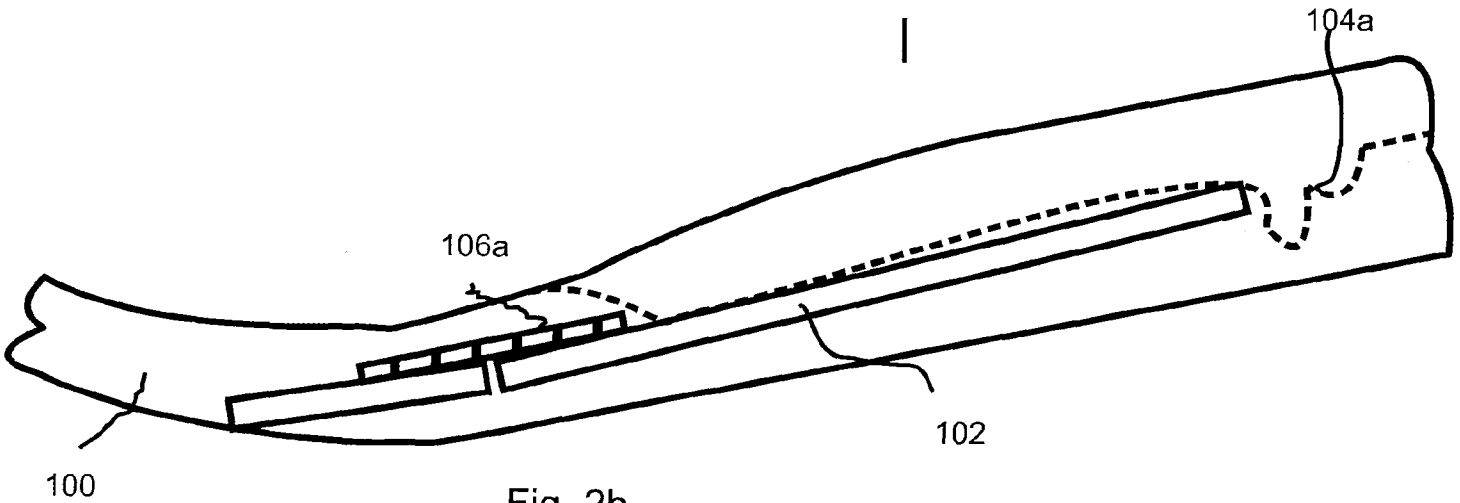
FIGS. 2*b* and 2*c* are schematic cross sectional views of the sole of FIG. 2*a* but disposed in different configurations.
Figure 2C:
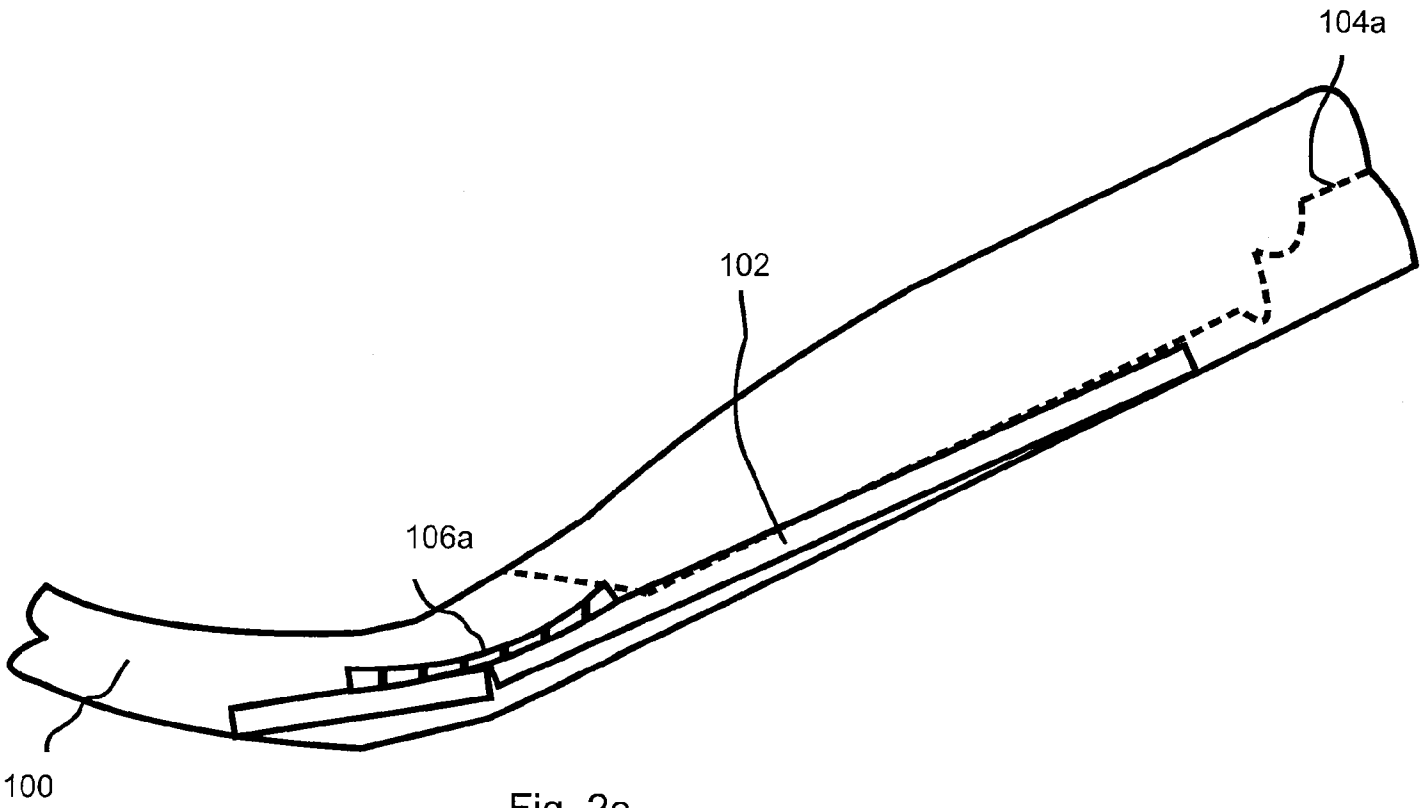
Figure 2D:
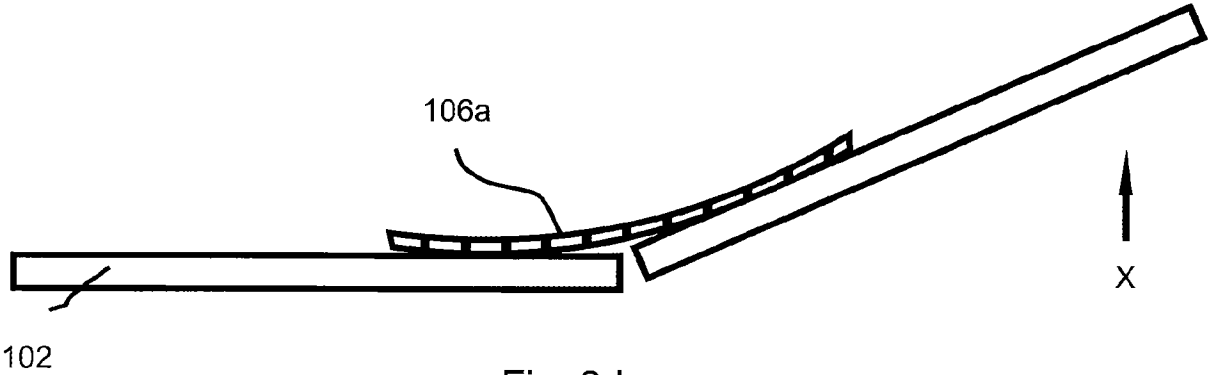
FIGS. 2*d* and 2*e* are schematic cross sectional views of a springboard of the sole shown in FIGS. 2*a*, 2*b* and 2*c;*
Figure 2E:
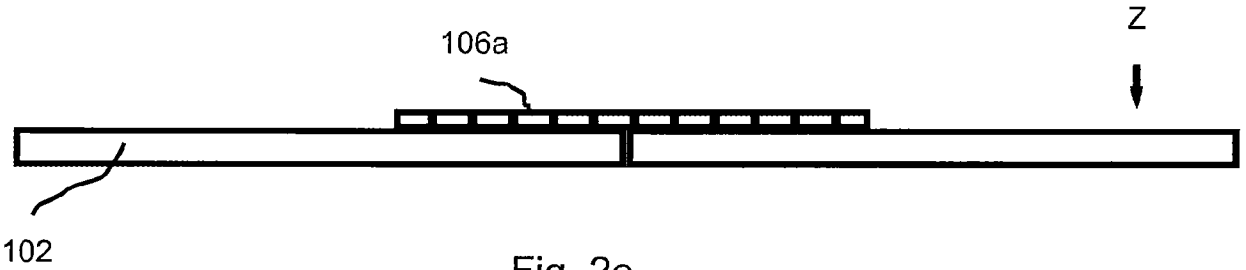
Figure 3A:
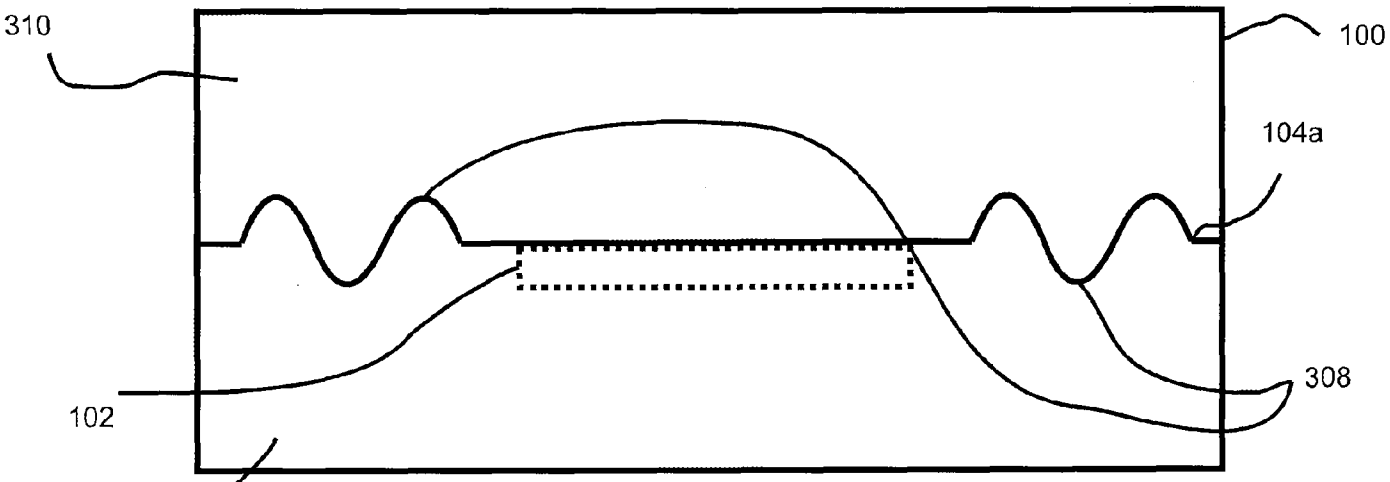
FIG. 3*a* is a schematic cross sectional view of the sole taken at line "Y" of FIG. 2*a;*
Figure 3B:
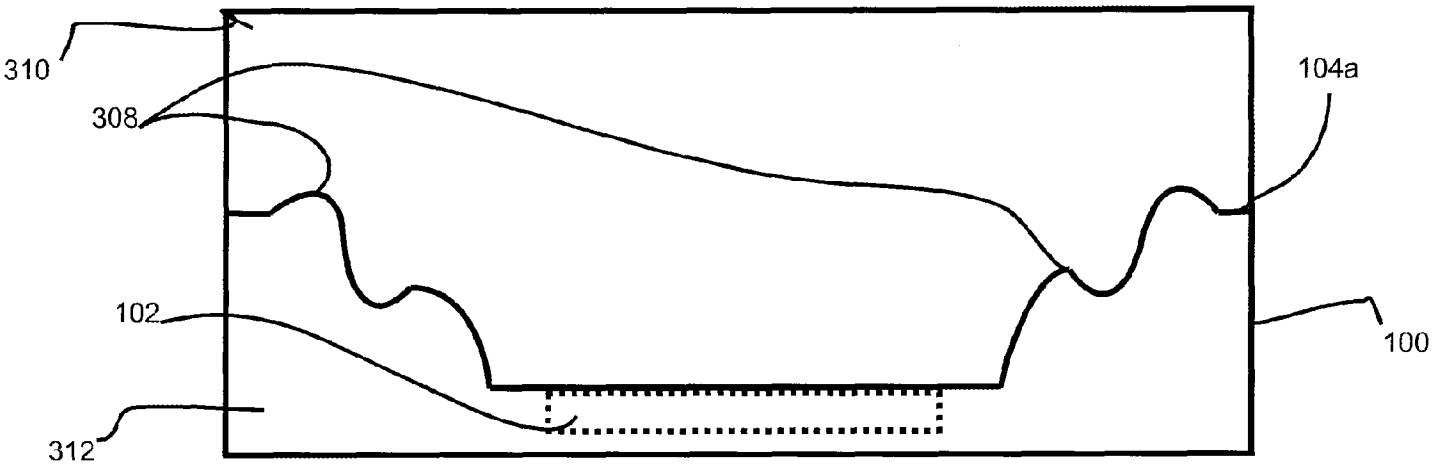
FIGS. 3*b* and 3*c* are schematic cross sectional views of the sole of FIG. 3*a* but disposed in different configurations.
Figure 3C:
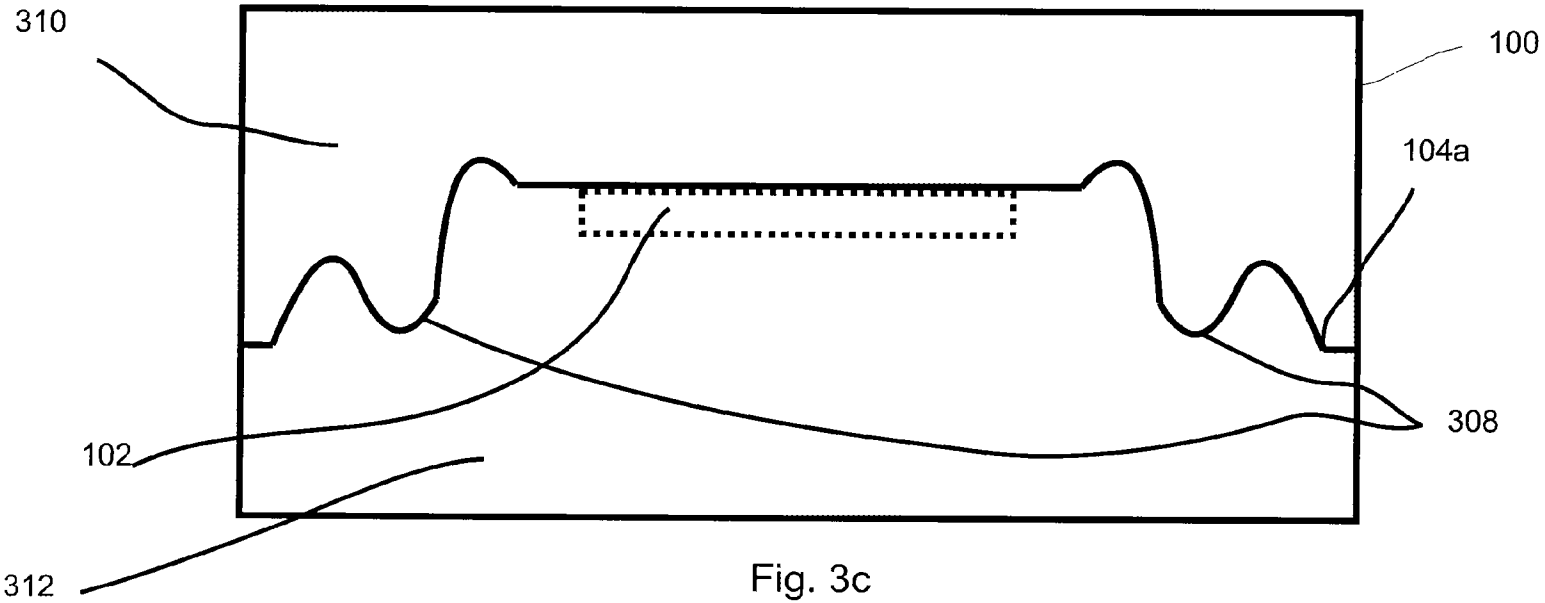

As can be seen, due to the lack of a bladder-type pump member in the sole 100, the membrane pump in FIGS. 2*a-c* occupies far less space in the cavity of the sole 100. In other words, the effectiveness of the pump is not hindered, or at least less hindered, by the limited space of the sole cavity. FIGS. 3*a-c* are cross sectional views taken a line "Y" in FIG. 2*a*, showing the sole 100.

Referring to FIG. 3*a*, it can be understood that in this embodiment the springboard 102 is provided and attached to a lower or downwardly facing surface of the membrane 308. However, in other embodiments the springboard 102 may be attached to a upper or upwardly facing surface of the membrane 308. The membrane 308 divides the cavity within the sole 100 into two chambers 310, 312. In other words, the membrane 308 and the walls of the sole 100 on one (the upper) side of the perimeter of the membrane 303 define a first chamber 310 while the membrane 308 and the walls of the sole 100 on the other (the lower) side of the perimeter of the membrane 308 define a second chamber 312. Each of these separate chambers 310 and 312 can act as a separate pump in a dual efficiency pump. It is to be noted that the membrane 104*a* is constructed to be loose in that there is provided a certain degree or number of foldings in the form of vertical grooves or folds. Due to this loose construction, the membrane 104*a* is not unnaturally deformed by the lateral movement of the springboard 102 in use. This is to be contrasted with a bladder-type pump as explained earlier on in this description.

It is envisaged that in use movement of the springboard 102 causes the membrane 104*a* to move up and down and so as to provide pumping action.

Figure 4A:
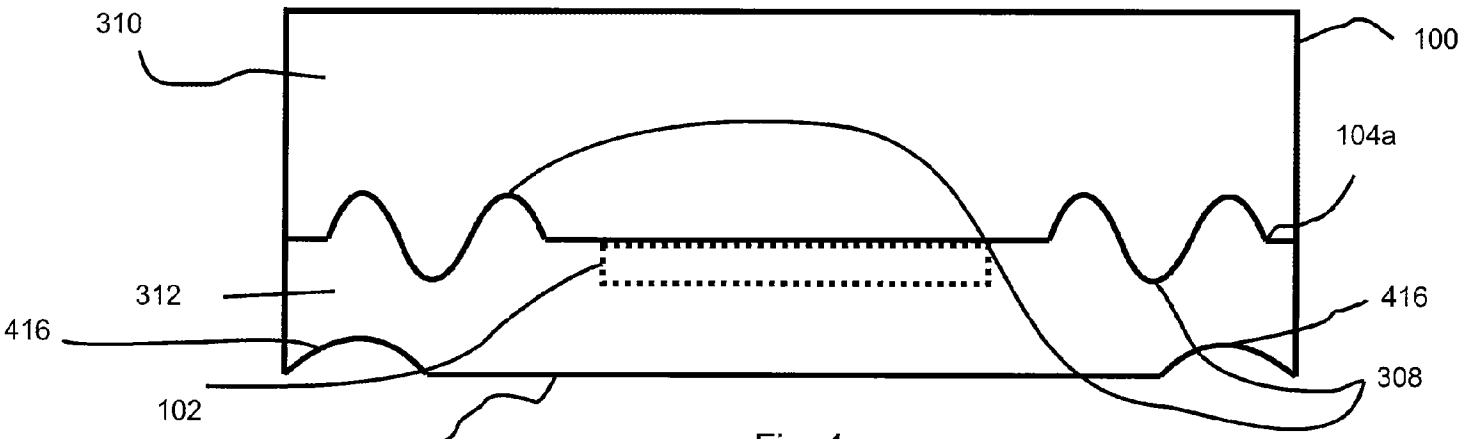
FIG. 4*a* is a schematic cross sectional view of an embodiment of a sole similar to the sole shown in FIGS. 3*a* to 3*c* but provided with an enhanced bottom wall.
Figure 4B:
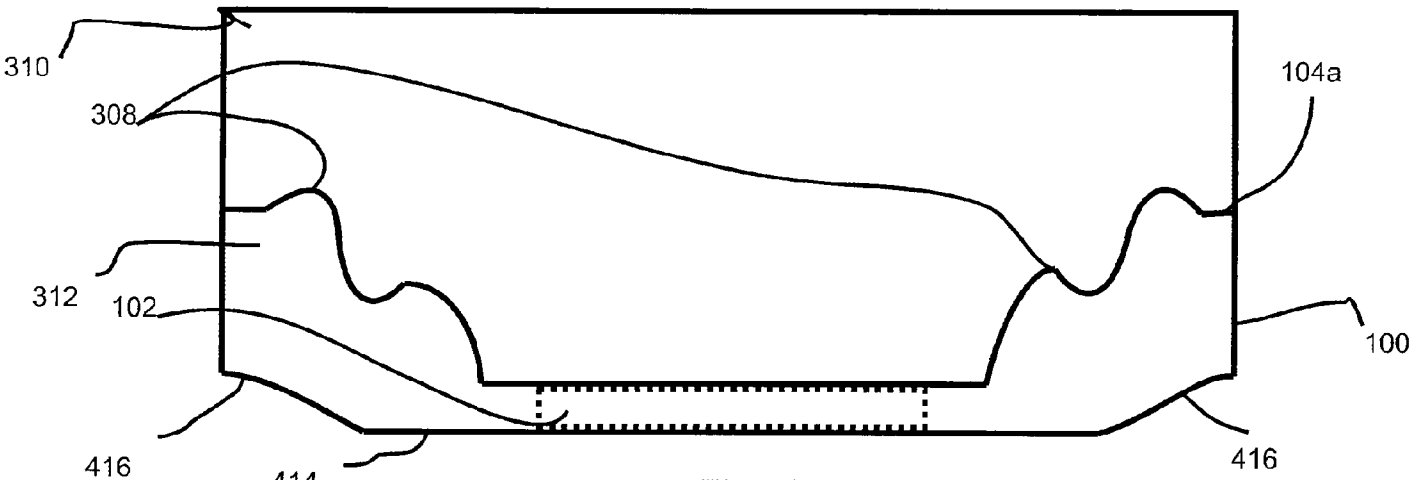
FIG. 4*b* is a schematic cross sectional view of the sole shown in FIG. 4*a* but disposed in a different configuration.
Figure 4C:
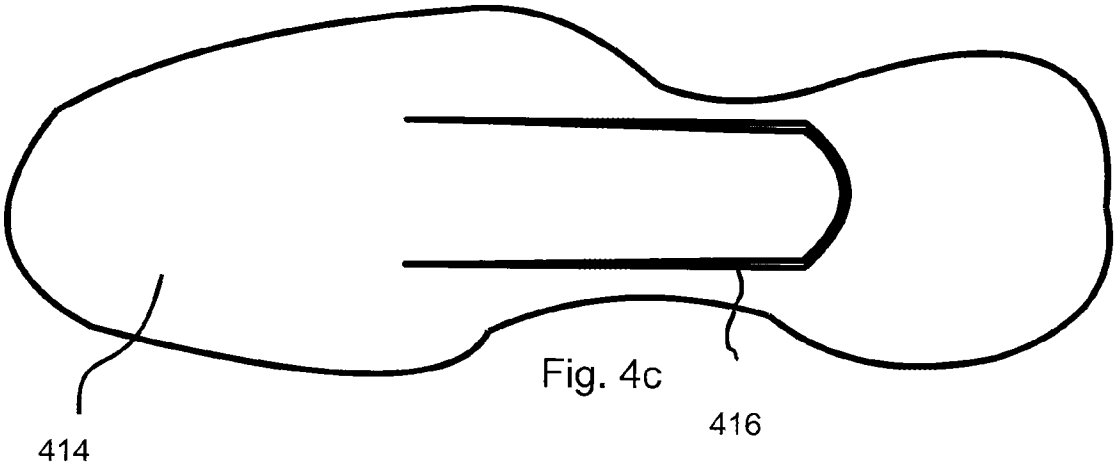
FIG. 4*c* is schematic bottom view of the sole shown in FIGS. 4*a* and 4*b;*

FIGS. 4*a-c* depict an embodiment of a pump assembly for use in a sole for an aerated footwear article. The pump assembly is generally similar to the one adopted and shown in FIGS. 2*a-c* and 3*a-c*. However, this pump assembly differs in that the sole 100 is provided with a bottom surface or sole covering 414 with vertical grooves or folds 416 (similar to those in the membrane). The vertical grooves or folds 416 is adapted to allow the bottom surface or sole covering 414 to bulge or outwardly expand when the springboard actuator 102 moves downwardly and the membrane expands towards the bottom surface. In particular, FIG. 4*c* shows a bottom view of the bottom surface or sole covering 414 and how the vertical grooves or folds 416 can be arranged to allow expansion of the bottom surface or sole covering 414 to allow greater movement of the membrane 104*a*. From FIG. 4*c*, it can be seen that there is a region of the bottom wall of the sole 100 in the form of a tongue. The tongue region is connected to the rest of the bottom wall with thinner wall forming the grooves or folds, thus allowing the tongue region to expand outwardly. The springboard actuator 414 may be sized and shaped to roughly conform to that of the tongue region such that as the springboard actuator 414 in the sole is caused to move towards the tongue region, the tongue region bulges out, causing expansion of the cavity within the sole 100.

Figure 5A:
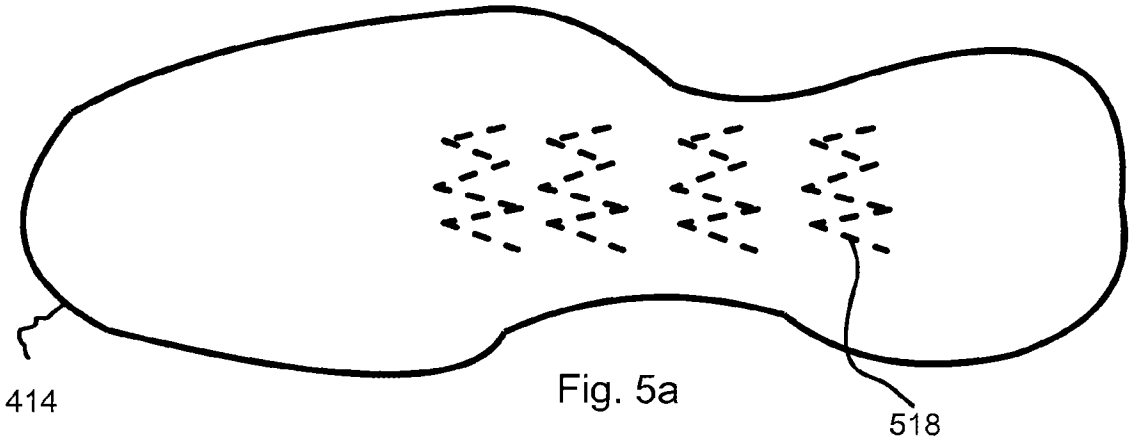
FIG. 5*a* is a schematic bottom view showing an embodiment of a bottom wall of a sole.
Figure 5B:
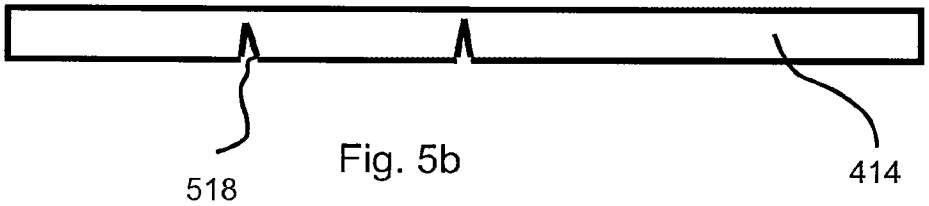
FIG. 5*b* is a cross sectional view of the bottom wall shown in FIG. 5*a;*

FIGS. 5*a* and 5*b* show an alternative embodiment of a sole covering 414. This sole covering is similar to the sole covering of FIG. 4*c*. However, instead of using the sole covering 414 with vertical grooves or folds 416, micro-incisions 518 are provided at the bottom surface or sole. These micro-incisions are tiny incisions that are largely unseen when the sole is straightened but open up when the sole is bent allowing for easier bending or stretching. In any event, the covering 414 is still constructed to be able to bulge out easier and with less force. FIG. 5*a* shows a view similar to the one in FIG. 4*c* while FIG. 5*b* shows a cross section of the bottom surface or sole covering 414 illustrated in FIG. 5*a*.

Figure 6A:
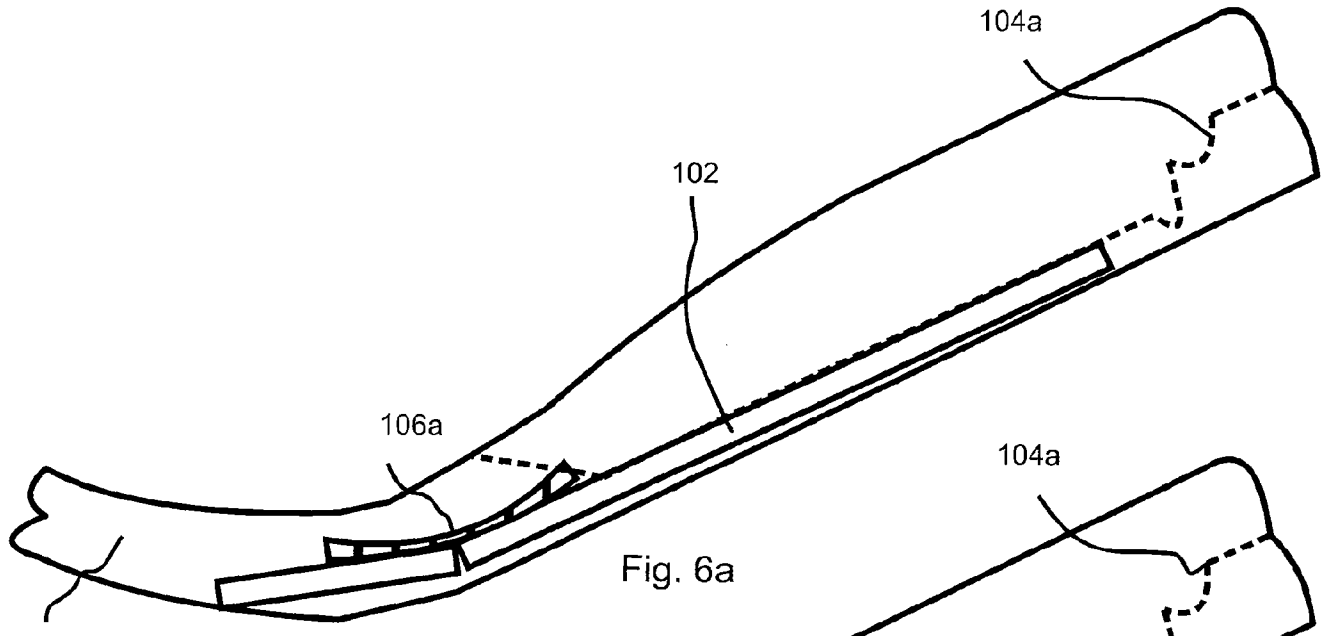
FIG. 6*a* is a schematic cross sectional view of an embodiment of a sole similar to the sole shown in FIGS. 2*a-c*.

FIG. 6*a* shows a sole 100 similar to that in FIG. 2*c*.

Figure 6B:
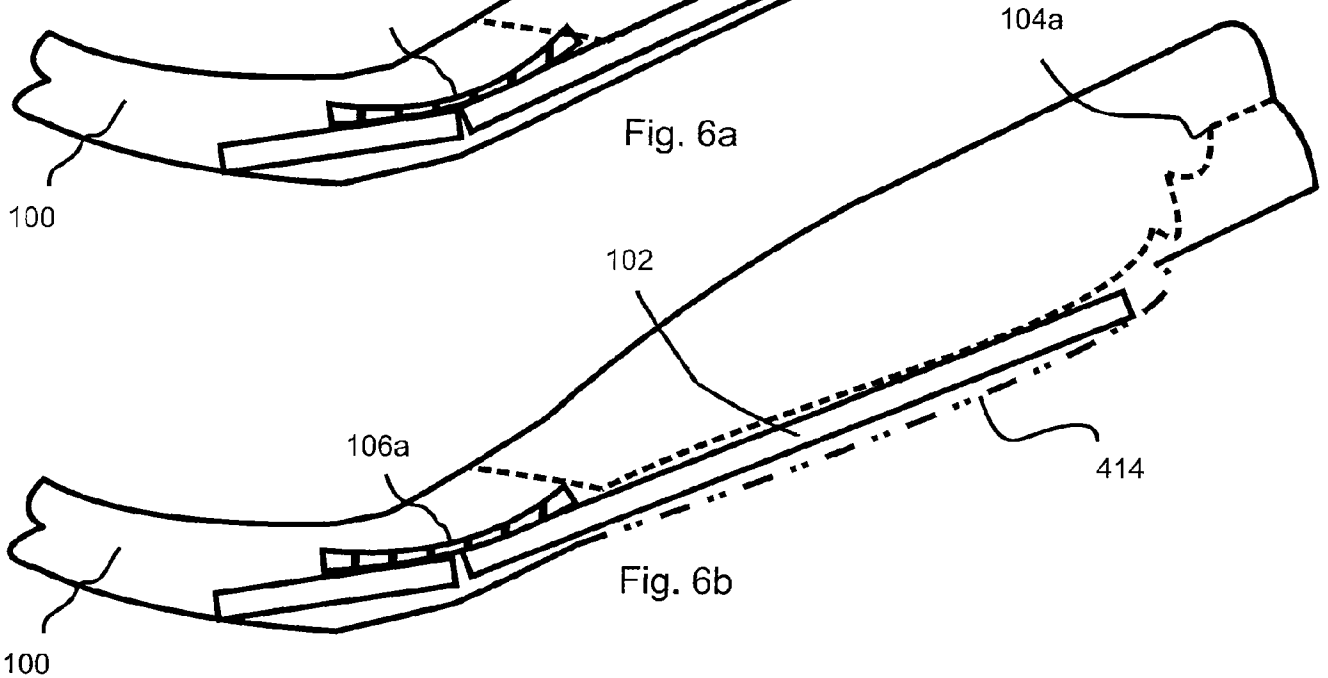
FIG. 6*b* is a schematic cross sectional view of an embodiment of a sole for use in an article of footwear but provided with a bottom wall shown in either FIGS. 4*a-c* or FIG. 5-*b*.

FIG. 6*b* shows a sole similar to the sole 100 in FIG. 6*a* but with a bottom surface or sole covering 414 incorporating either the arrangement in 4*a*, 4*b*, 4*c* or 5*a* and 5*b* or both. As can be seen in FIG. 6*b*, the sole covering 414 can expand outward to accommodate greater movement of the membrane 104*a* of the membrane pump.

A sole body as described above can be manufactured by firstly moulding a sole member with surrounding walls such that the surrounding walls defining a cavity therebetween. A membrane member defining a perimeter and appropriately sized and shaped can then be fixedly connected to the surrounding walls at the perimeter. This may be done by adhering the membrane member to the surrounding walls by an adhesive. Alternatively, the membrane member may be attached to the walls by heat sealing. The cavity is then enclosed by connecting a covering member to the surrounding walls. The covering member may be adapted to be puncture proof for protecting pumping mechanism (e.g. the membrane member) within the cavity. Alternatively, a further puncture proof layer may be adhered to the bottom wall of the sole. In one embodiment of the present invention, there is a further step of connecting an actuation member to the membrane member for operating the membrane member in use.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples.

The invention claimed is:

1. An article of footwear, comprising:

a) a shoe upper;

b) a sole connected to the shoe upper and the sole is provided with peripheral walls which together define a cavity therein;

c) a layer of material situated in the cavity, the cavity defined by the sole and the peripheral walls, and the layer of material extending across and is directly connected to the peripheral walls, the layer of material dividing the cavity horizontally from a front end of the sole to a rear end of the sole into at least a first chamber and a second chamber separated from the first chamber, wherein the layer of material and the peripheral walls, on one side of the perimeter of the layer of material, define the first chamber, and the layer of material and the peripheral walls, on the other side of the perimeter of the layer of material, define the second chamber;

d) an elongate actuation member situated in the cavity and extending from the front end of the sole to the rear end of the sole, the elongate actuation member is provided with a front portion and a rear portion pivotably movable relative to, the front portion; and e) the sole is configured such that movement of the layer of material within the cavity causes an increase in interior volume of the first chambers and a decrease in interior volume in the second chamber, or vice versa, thus pumping air into or out of the chambers for air circulation of the article of footwear;

wherein the elongate actuation member is fixedly connected to the layer of material such that upwardly bending of the rear end of the sole relative to the front end of the sole stretches the layer of material, and expanding the volume within the first chamber and reducing the volume within the second chamber.

2. An article of footwear as claimed in claim 1, wherein the layer of material is relatively elastic and flexible and in the form of a membrane.

3. An article of footwear as claimed in claim 1, wherein the layer of material defines vertical grooves or folds for facilitating resilient stretching thereof.

4. An article of footwear as claimed in claim 1, wherein the actuation member is adapted such that, in use, the rear portion of the actuation member from a default configuration in relation to the front portion of the actuation member is stiffer to bend down than to bend up, or vice versa.

5. An article of footwear as claimed in claim 4, wherein the rear portion generally defines a first plane and the front portion generally defines a second plane, and wherein the default configuration is defined by an angle between the first plane and the second plane or relative position of the front and rear portions.

6. An article of footwear as claimed in claim 1, comprising a hinge member connecting an upper surface of the front and rear portions of the elongate actuation member and allowing upwardly pivotable movement of the rear portion.

7. An article of footwear as claimed in claim 1, comprising an expansion allowance means for allowing expansion of the volume of the cavity within the sole.

8. An article of footwear as claimed in claim 7, wherein the peripheral walls include a bottom wall provided with a stretchable portion which, in response to bending of the sole, facilitates the stretchable portion to bulge out, thus allowing the elongate actuation member connected to the layer of material to move a greater distance away from the cavity and/or to provide a greater pumping action.

9. An article of footwear as claimed in claim 7, wherein the expansion allowance means includes a region at a bottom wall of the sole that is thinner or more stretchable than regions of the sole surrounding the thinner or more stretchable regions.

10. An article of footwear as claimed in claim 9, wherein the expansion allowance means comprises a plurality of grooves or folds at the thinner or more stretchable region.

11. An article of footwear as claimed in claim 9, the expansion allowance means comprises micro-incisions at the thinner or more stretchable region.

12. A sole for use in an article of aerated footwear, comprising:

a) a sole body connectable to a shoe upper, the sole body provided with peripheral walls which together define a cavity therein;

b) a membrane situated in the cavity defined by the sole body, and is directly connected to the peripheral walls at a perimeter of the membrane and dividing the cavity horizontally from a front end of the sole to a rear end of the sole into at least a first chamber and a second chamber separated from the first chamber, wherein the membrane and the walls, on one side of the perimeter of the membrane, define the first chamber, and the membrane and the walls, on the other side of the perimeter of the membrane, define the second chamber;

c) an elongate actuation member situated in the cavity and extending from the front end of the sole to the rear end of the sole, the elongate actuation member is provided with a front portion and a rear portion pivotably movable relative to, the front portion; and d) the sole is configured such that movement of the membrane within the cavity causes increase in interior volume the first chamber and a decrease of interior volume of the second chamber, or vice versa, thus pumping of air into or out of the chambers for air circulation;

wherein the elongate actuation member is fixedly connected to the membrane such that upwardly bending of the rear end of the sole relative to the front end of the sole stretches the membrane, and expanding the volume within the first chamber and reducing the volume within the second chamber.

13. A method of manufacturing a sole body for an article of footwear, comprising steps of:

a) moulding a sole member with surrounding walls such that the surrounding walls defining a cavity therebetween;

b) providing a membrane member in the cavity defining a perimeter and sized and shaped to connect to the surrounding walls at the perimeter;

c) fixedly connecting the membrane member to the surrounding walls such that the membrane separates the cavity horizontally from a front end of the sole to a rear end of the sole into a first chamber and a second chamber;

d) providing an elongate actuation member and positioning the elongate actuation member in the cavity along the length of the sole member, and connecting the elongate actuation member to the membrane member such that movement of a rear portion of the elongate actuation member relative to a front portion of the elongate actuation member causes an increase in interior volume of the first chamber and a decrease in interior volume of the second chamber, or vice versa, and e) enclosing the cavity by connecting a covering member to the surrounding walls.

14. A method as claimed in claim 13, comprising a step of connecting an actuation member to the membrane member for operating the membrane member in use.

15. A method as claimed in claim 13, comprising the step of connecting the membrane member to the surrounding walls by gluing the membrane member to the surrounding walls.

* * * * *